United States Patent [19]

Mandlman

[11] 4,032,990

[45] July 5, 1977

[54] HEAT RESISTANT GLOVE HAVING ADDITIONAL PROTECTIVE PORTION IN GRIPPING AREA

[75] Inventor: Mayar Richard Mandlman, Bayside, Wis.

[73] Assignee: Apex Glove Co., Inc., Milwaukee, Wis.

[22] Filed: Dec. 3, 1976

[21] Appl. No.: 747,376

[52] U.S. Cl. ..... 2/161 R; 2/20

[51] Int. Cl.[2] ..... A41D 19/00

[58] Field of Search ..... 2/16, 20, 159, 161 R, 2/161 A, 163, 164, 169, 158, 160

[56] References Cited

UNITED STATES PATENTS

| | | | |
|---|---|---|---|
| 1,990,553 | 2/1935 | Koffler et al. | 2/20 |
| 2,069,449 | 2/1937 | Jensen | 2/20 |

*Primary Examiner*—G. V. Larkin
*Attorney, Agent, or Firm*—James E. Nilles

[57] ABSTRACT

A heat resistant glove for use in foundries or the like and for use in handling extremely hot objects such as molten metal ladles or the like. The glove has an insulating portion which fits between the liner of the glove and the outside glove. More particularly, the insulating porton is comprised of one piece and which is formed as a double pocket so that it can be simply slipped over both the index finger and the thumb of the liner before the liner is inserted in the outer glove. Thus, the gripping area of the hand is provided with additional insulative protection as are both the index finger and thumb. The double pocket portion is thus firmly secured between the glove liner and the outer glove without the need for sewing the insulating material in place or otherwise affixing it to the liner or the glove.

7 Claims, 4 Drawing Figures

HEAT RESISTANT GLOVE HAVING ADDITIONAL PROTECTIVE PORTION IN GRIPPING AREA

BACKGROUND OF THE INVENTION

Many prior art glove constructions have been proposed for protecting various portions of the hand or glove from wear or other abusive use. These devices have been proposed for use within the glove or exteriorly of the glove and have taken various shapes and modes of attachment to the glove proper. Examples of such prior art protective devices are shown in the U.S. Pat. No. 3,500,477 issued Mar. 17, 1970; U.S. Pat. No. 2,582,240 issued Jan. 15, 1952; U.S. Pat. No. 203,959 issued May 21, 1878; U.S. Pat. No. 709,595 issued Sept 23, 1902; U.S. Pat. No. 3,643,386 issued Feb. 22, 1972; U.S. Pat. No. 1,673,517 issued June 12, 1928; and U.S. Pat. No. 3,739,400 issued June 19, 1973.

SUMMARY OF THE INVENTION

The present invention relates to a heat resistant glove or the like and for use in situations where extreme heat is encountered and additional insulative protection is necessary in the gripping area of the hand, that is between the index finger and the thumb. The invention provides an insulative portion for location between a liner of a glove and the glove itself, and that portion is formed of a single piece of insulative material and which can be simply slipped over the index finger and thumb of the glove before the liner is inserted in the glove and thus securely held in place without the additional attaching means by sewing or the like.

A more specific aspect of the invention relates to an insulative portion of the above type having a pocket at each of its ends, and which can be reversed end for end, that is, either end can be used for mounting on the thumb and furthermore, which insulating portion can be reversed for use on either the left or right hand. The resulting heat resistant glove has an insulating portion between the liner and the glove in the critical gripping area of the hand, is economical to manufacture, easy to use, not bulky in operation, economical to assemble, requires a minimum of parts to be stocked for use with either left or right hands, and which cannot be incorrectly assembled by the production worker.

These and other objects and advantages of the present invention will appear hereinafter as this disclosure progresses, reference being had to the accompanying drawings.

DESCRIPTION OF A PREFERRED EMBODIMEMT

Figure 1:
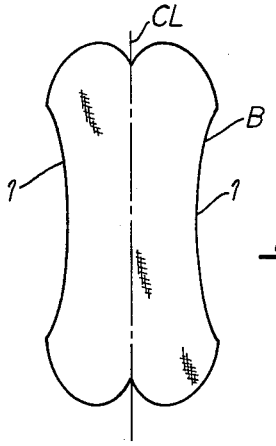
FIG. 1 is a view of a blank piece of material from which the insulating pocket portion is made.

The blank B shown in FIG. 1 and from which the insulative portion is fabricated can be of any desirable type of material such as cloth, asbestos, leather and so forth. It will be noted that the blank is symmetrical about its longitudinal centerline CL, and is shown with a slightly inwardly curved side 1, although the shape of the side 1 can be varied somewhat depending on the extent of area to be protected in the gripping area of the hand as will appear.

Figure 2:
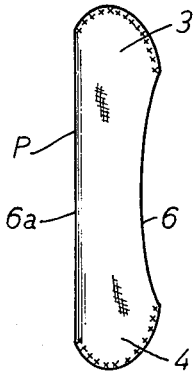
FIG. 2 is a view of the pocket portion shown in FIG. 1, but when folded along its centerline and sewn together at each of its ends.
Figure 3:
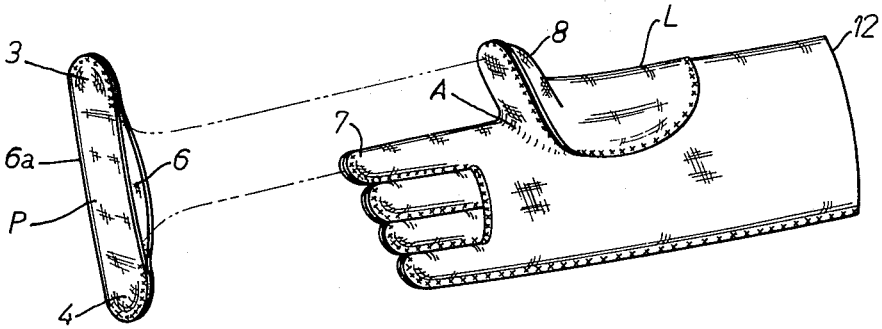
FIG. 3 is a perspective view of the pocket portion shown in FIG. 2, but when opened up slightly along its open length and when it is about to be placed over the index finger and thumb of a liner of a glove.

FIG. 2 shows the blank of FIG. 1 after it has been folded along its centerline CL and then sewn together over its opposite ends so as to form end pockets 3 and 4 in the resulting insulating portion P. The index finger and thumb of a glove liner can be inserted into pockets 3 and 4 of the insulating portion P. The portion P also has an open longitudinal edge or side 6 which as shown in FIG. 3 can receive a glove liner L. The other edge of side *6a* of the insulating portion P forms a closed longitudinal side.

The glove liner L is of conventional character and has an index finger 7 and a thumb 8 over which the insulating portion P is slipped prior to the liner being inserted in the gloove G. More specifically, the end pockets of portion P are slipped over the index finger 7 and thumb 8 until the portion is snugly received on the liner as shown in FIG. 4.

Figure 4:
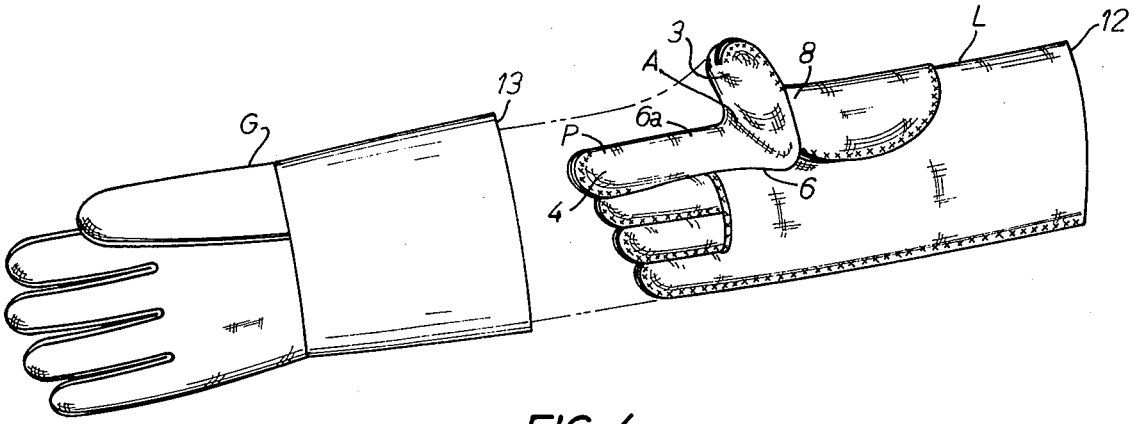
FIG. 4 is a view of the pocket portion as assembled on the index finger and thumb of a glove liner and when the assembled pocket and liner is about to be inserted in the outer glove.

When the liner and portion P have been assembled as shown in FIG. 4, the resulting liner assembly is then inserted in the glove G until the corresponding fingers and thumbs of the assembly and glove are firmly interengaged or assembled. Then the rear wrist edge 12 of the liner is sewn to the rear wrist 13 of the glove, holding the liner securely within the glove. It will be noted however, that it is unnecessary to sew or otherwise affix the insulation portion P to the liner or to the glove, but rather when the liner has been assembled in the glove, the double pocket insulating portion P is firmly locked in porper position.

The portion P thus additionally insulates the finger and thumb and particularly the gripping area A of the hand.

The insulating portion P is symmetrical, end for end, and either end pocket of the portion can be inserted on the thumb or index finger. Furthermore, the insulating portion P can be used with either a right hand or left hand glove.

The insulating portion is economical to manufacture, economical to assemble, and requires a minimum number of parts to stock. The insulating portion cannot be incorrectly assembled in the glove and it can be used for either left or right hand gloves.

Added protection in the glove area of the hand is achieved by simply hooking the insulating portion of the index finger and thumb on a glove liner, prior to the liner being assembled in the glove. No sewing or other affixation is required for the insulating portion in order to hold it in assembled position. Considerable cost saving is possible by means of the present invention and material cost have been minimized in providing good insulating protection in the vital gripping area of the hand.

I claim:

1. An insulated glove having a liner and also having an outer glove into which the liner is assembled, said liner and glove each having an inter-engaging index finger and thumb with a gripping area therebetween, an insulating portion for said gripping area formed of flexible, heat resistant material and having a pocket at each of its ends, said pockets slipped over the index finger and thumb of said liner and said insulating portion covers said liner gripping area, said liner inserted in said glove with said index finger and said thumb of said insulating portion inserted in said index finger and thumb of said glove and held in assembled relationship between said liner and outer glove.

2. An insulated glove having a liner and also having an outer glove into which the liner is assembled, said liner and glove each having an inter-engaging index finer and thumb with a gripping area therebetween, an insulating portion for said gripping area formed of flexible, heat resistant material and having a pocket at each of its ends, said insulating portion also having an open longitudinal edge between said pockets, said pockets slipped over the index finger and thumb of said liner and said open edge receives said gripping area of the liner between the index finger and thumb and thereby said insulating portions covers said liner gripping area, said liner and insulating portion forming a liner assembly, said liner assembly inserted in said glove with said index finger and said thumb of said insulating portion inserted in said index finger and thumb of said glove, said insulating portion being firmly held in assembled relationship between said liner and outer glove.

3. An insulated glove having a liner and also having an outer glove into which the liner is assembled, said liner and glove each having an inter-engaging index finger and thumb with a gripping area therebetween, an elongated insulating portion for said gripping area formed of flexible, heat resistant material and having opposite ends which each define a pocket, said insulating portion also having a closed longitudinal side and an opposite open longitudinal side, said pockets slipped over the index finger and thumb of said liner and said open side receives said gripping area of the liner between the index finger and thumb and thereby said insulating portion covers said liner gripping area, said liner and insulating portion forming a liner assembly, said liner assembly inserted in said glove with said index finger and said thumb of said insulating portion inserted in said index finger and thumb of said glove, said insulating portion being firmly held in assembled relationship between said liner and outer glove.

4. The glove set forth in claim 3 further characterized in that said pockets are similar to one another whereby said portion can be reversed end for end between said index finger and thumb, said portion also being symmetrical whereby it can be used for either a right or left hand.

5. The glove set forth in claim 4 further characterized in that said insulating portion is formed from a single blank piece of material which is folded over itself along a longitudinal centerline of said blank piece of material.

6. An elongated insulating protion for an insulated glove and formed of flexible heat resistant material, said portion having opposite ends each defining a pocket for the reception of an index finger and a thumb, said portion having a closed longitudinal side and an opposite open longitudinal side, said pockets being similar to one another whereby said portion can be reversed end for end between an index finger and thumb, said portion also being symmetrical whereby it can be used for either a right or left hand.

7. The insulating portion set forth in claim 6, further characterized in that it is formed from a single blank piece of material which is folded over itself along a longitudinal centerline of said blank piece of material.

* * * * *